US005762332A

United States Patent [19]

Haroutel et al.

[11] Patent Number: 5,762,332

[45] Date of Patent: Jun. 9, 1998

[54] OPTIMIZED DRIVE DEVICE FOR DRIVING ITEMS OF MAIL

[75] Inventors: Jean-Claude Haroutel, Orsay; Michel Serruya, Parts, both of France

[73] Assignee: Neopost Industrie, Bagneux, France

[21] Appl. No.: 791,613

[22] Filed: Jan. 31, 1997

[30] Foreign Application Priority Data

Jan. 31, 1996 [FR] France ..... 96 01126

[51] Int. Cl.[6] ..... B65H 5/06

[52] U.S. Cl. ..... 271/274; 198/624

[58] Field of Search ..... 271/273, 274, 271/272; 198/624

[56] References Cited

U.S. PATENT DOCUMENTS

| | | | |
|---|---|---|---|
| 4,461,212 | 7/1984 | Geney | 271/274 |
| 4,750,853 | 6/1988 | Soest et al. | 198/624 |
| 4,762,314 | 8/1988 | Harada | 271/274 |
| 5,152,519 | 10/1992 | Ifkovits | 271/274 |
| 5,203,263 | 4/1993 | Berger et al. . | |
| 5,203,846 | 4/1993 | Kuhns et al. . | |
| 5,575,465 | 11/1996 | Auerbach et al. | 271/274 |

FOREIGN PATENT DOCUMENTS

| | | |
|---|---|---|
| 0382497A2 | 8/1990 | European Pat. Off. . |
| 2519583 | 7/1983 | France . |

*Primary Examiner*—H. Grant Skaggs
*Attorney, Agent, or Firm*—Sughrue, Mion, Zinn, Macpeak & Seas, PLC

[57] ABSTRACT

A drive device for driving items of mail along a conveyor path of a postage meter base, the device being disposed upstream from a print mechanism and including first and second motorized feed rollers cooperating with associated moving backing-rollers mounted on hinged means which can pivot about a common hinge axis against return springs fixed to support means, at least one of the backing-rollers comprising a middle backing-wheel mounted on a lever hinged about the common axis and disposed between twin outer backing-wheels each mounted on a respective lever also hinged about a common axis, such that mail items inserted on the conveyor path come into contact with one only of the outer backing-wheels and the middle backing-wheel, or else with all three backing-wheels, depending respectively on whether or not the items are thinner or thicker than a predetermined thickness.

5 Claims, 3 Drawing Sheets

OPTIMIZED DRIVE DEVICE FOR DRIVING ITEMS OF MAIL

FIELD OF THE INVENTION

The present invention relates to the field of mail processing and relates in particular to a device for conveying and driving items of mail of various thicknesses.

PRIOR ART

Conventionally, a postage meter or "franking machine" must be adapted to receive various types of mail items such as documents, envelopes, or packets of various thicknesses. European patent application EP 0 382 497 shows such a postage meter having a base which, in addition to having an input feed roller and a output ejection roller, is provided with an additional free roller flexibly mounted to cooperate with the ejection roller and thus making it possible to take account of the various thicknesses of the driven items by adjusting the vertical gap between the moving roller and the ejection roller.

However, that structure still presents numerous drawbacks due both to its considerable complexity (the additional roller must be disposed at the print mechanism), and especially to the fact that it exerts identical very high pressure whatever the type of document driven (since the pressure of the roller must be set as a function of the maximum acceptable thickness).

In addition, as shown in the prior art device illustrated in FIG. 3, when the conveyor device 2 includes a motorized input roller 4 acting against a backing-roller 6, the mail items frequently jam on input into the conveyor device as a result of a thick item 8 firstly coming into abutment against the backing-roller 6 and lifting it up, tending to cause the mail item to stop before it comes into contact with the motorized roller 4 inside a base 10 of the postage meter, and designed to drive the mail item to the print mechanism.

OBJECT AND BRIEF SUMMARY OF THE INVENTION

An object of the present invention is to mitigate those drawbacks by proposing a drive device for driving items of mail automatically, the device being disposed immediately upstream from the print mechanism, and being provided with means enabling the various thicknesses of the mail items to be taken into account optimally.

These objects are achieved by providing a drive device for driving items of mail along a conveyor path of a postage meter base, the device being disposed upstream from a print mechanism and including first and second motorized feed rollers cooperating with associated moving backing-rollers mounted on hinged means which can pivot about a common hinge axis against return springs fixed to support means, at least one of the backing-rollers comprising a middle backing-wheel mounted on a lever hinged about the common axis and disposed between twin outer backing-wheels each mounted on a respective lever also hinged about a common axis, such that mail items inserted on the conveyor path come into contact with one only of the outer backing-wheels and the middle backing-wheel, or else with all three backing-wheels, depending respectively on whether or not the items are thinner or thicker than a predetermined thickness.

By using this particular structure for the drive device, small pressure is applied on the thin items and higher pressure is exerted on thick items, thus taking better account of the different thicknesses of the mail items.

To ensure an even pressure, the hinged levers of the outer backing-wheels are advantageously interconnected by means of a spacer.

The hinged levers of the outer backing-wheels include a polygonal cutouts designed to cooperate with two faces of an abutment in order to define upper and lower pivoting limits for pivoting the levers. The upper abutment position is fixed by the structure itself of the conveyor path for mail items in the postage meter, and the lower abutment position determines the thickness from which the backing-wheels act together.

Each backing-wheel is preferably cantilevered out on one end of its respective hinged lever.

The backing-wheels advantageously present a predetermined radius less than the radius of the associated motorized feed roller, such that when a document is inserted into the base of the postage meter, the document is driven by the motorized roller before coming into contact with the backing-wheels. Thus, it is possible to avoid jamming of the documents on input into the drive device.

BRIEF DESCRIPTION OF THE DRAWINGS

Other characteristics and advantages of the present invention appear further from the following description given by way of non-limiting indication, and made with reference to the accompanying drawings, in which.

DETAILED DESCRIPTION OF A PREFERRED EMBODIMENT

Figure 3:
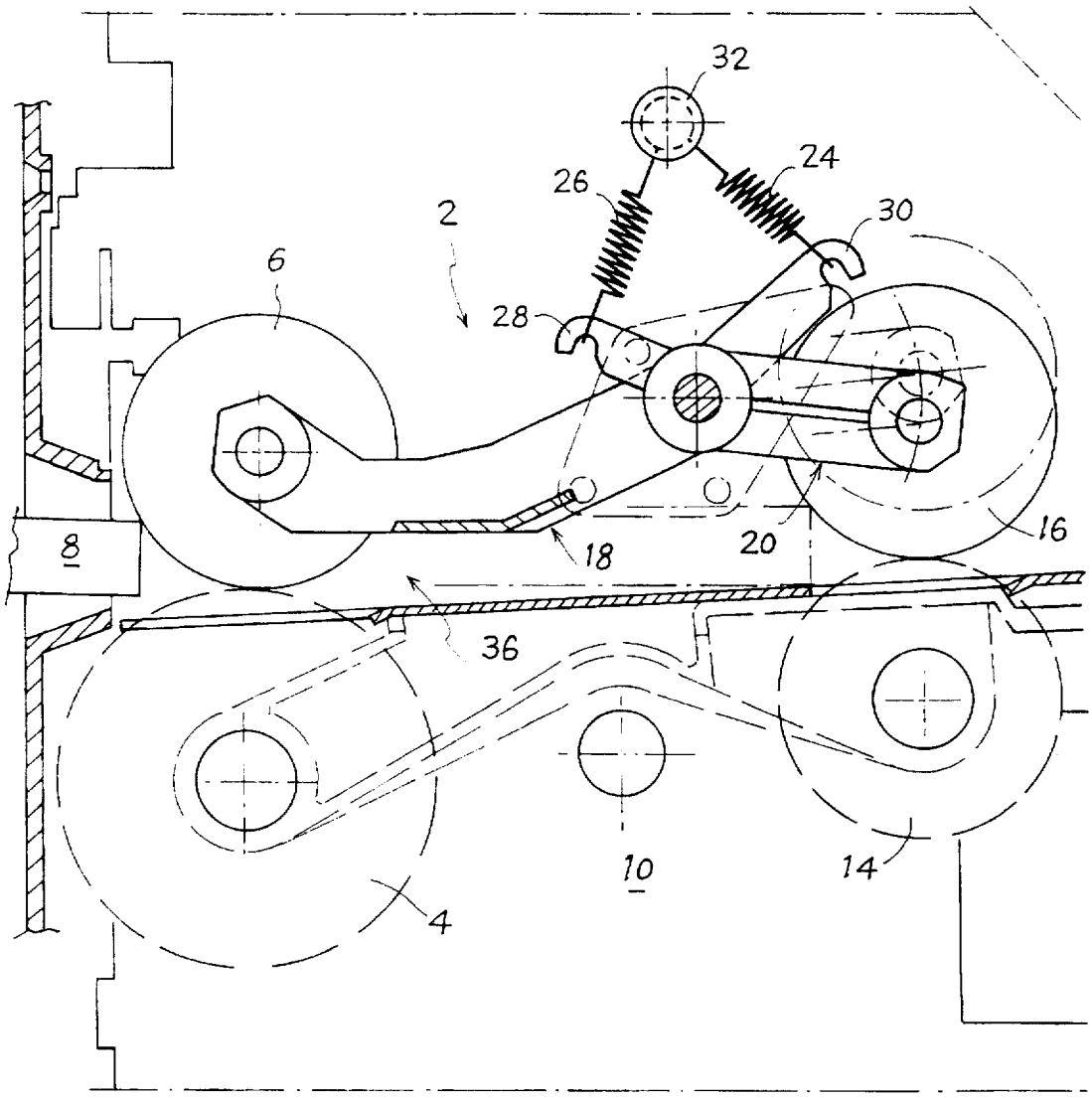
FIG. 3 is, in longitudinal, fragmentary cross-section, showing a prior art drive device for a postage meter.

Initially, consideration is given to FIG. 3 which shows a mail item drive device of the prior art disposed in the base 10 of a postage meter, upstream from a print mechanism (not shown). The drive device 2 includes first and second motorized feed rollers 4, 14 mounted on a fixed support 12, and having two moving backing-rollers 6, 16 facing them. Each backing-rollers is held at one end of respective fork-shaped means 18, 20, which means are hinged about a common axis 22 and can pivot in opposition to return springs 24, 26 fixed between hook-shaped ends 28, 30 remote from the forks and a common support pin 32 secured to a side plate 34 of the postage meter base 10. In the rest position shown, in the absence of any mail item, and under the action of the return springs 24, 26, the rollers and backing-rollers are in mutual contact, temporarily closing the conveyor path 36 for the mail items.

Figure 1:
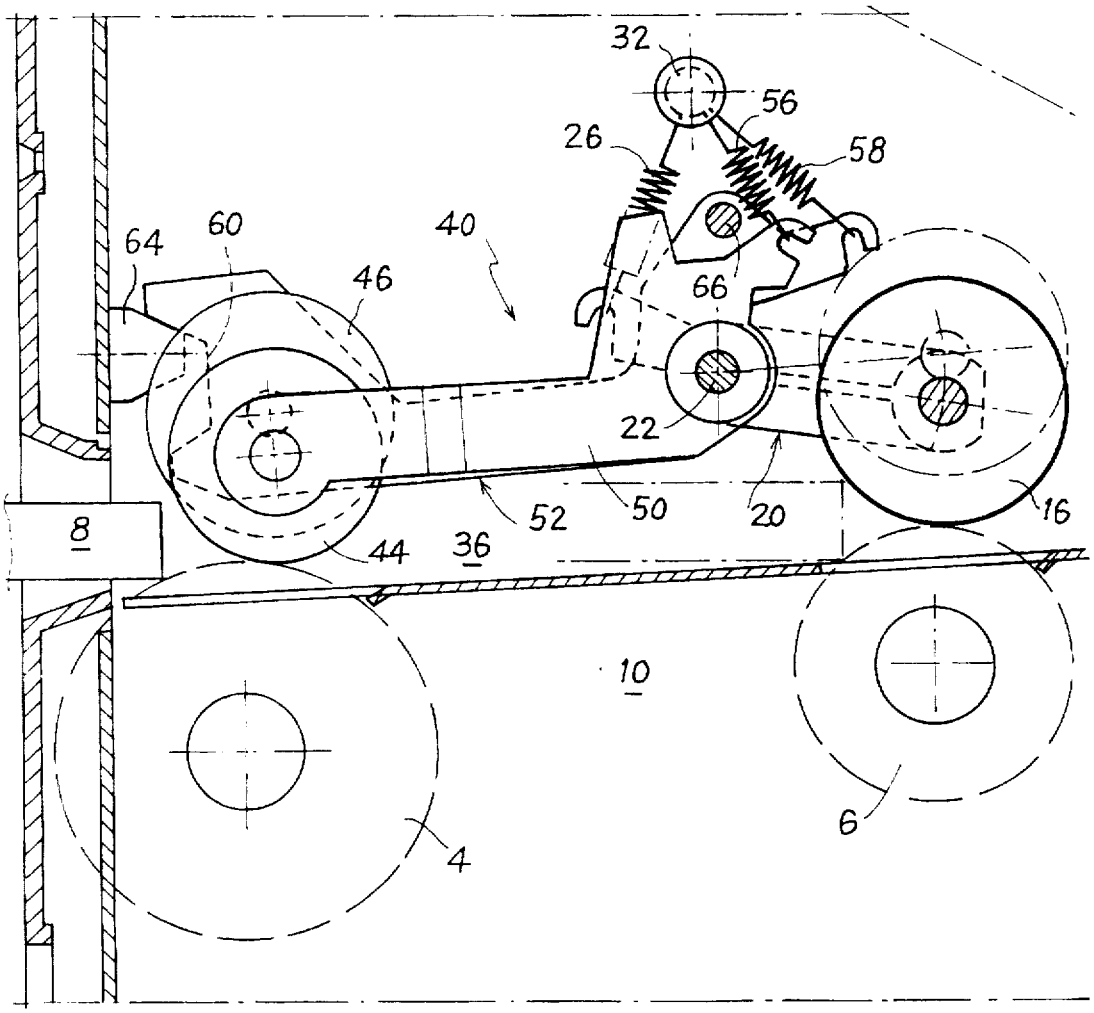
FIG. 1 is a longitudinal, fragmentary cross-section view of a postage meter provided with a mail item drive device of the invention.
Figure 2:
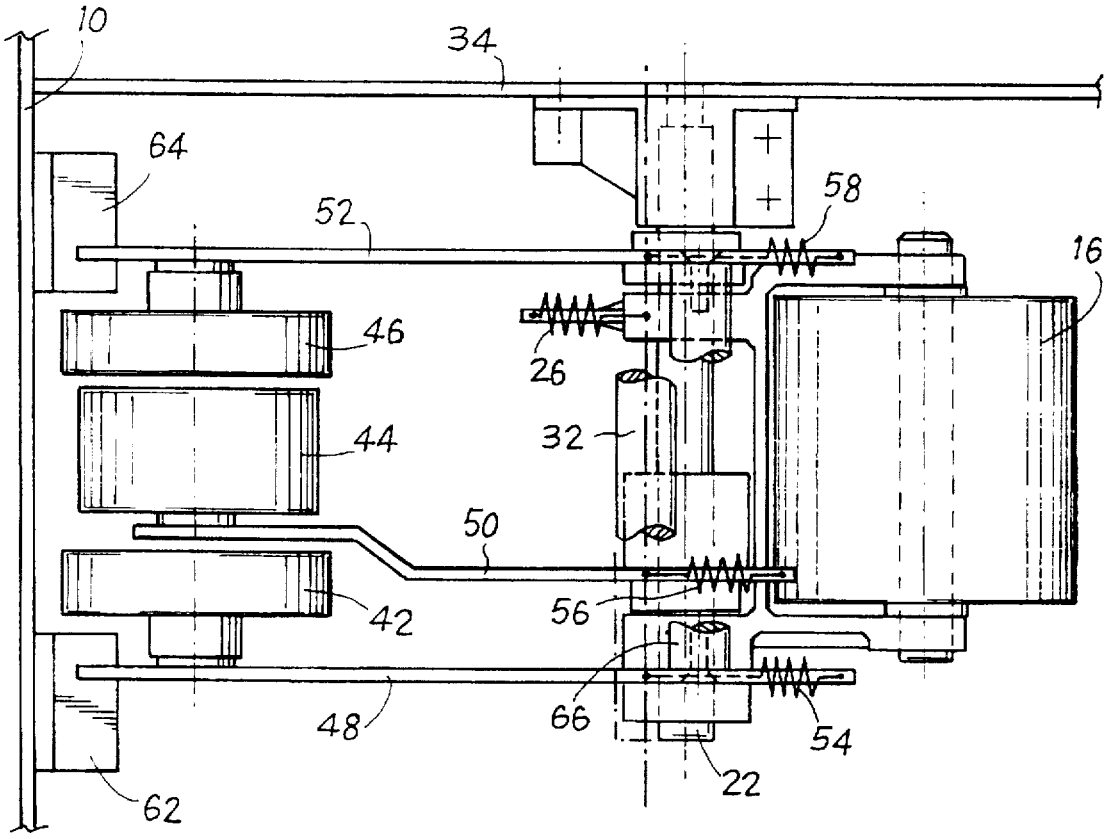
FIG. 2 is a view from above of the drive device shown in FIG. 1.

Consideration is now given to FIGS. 1 and 2 which show respectively in elevation section and in plan view, a mail item drive device of the invention 40 also disposed in the base 10 of a postage meter, upstream from its print mechanism. To clarify the description, the same references have been given to the elements of the device 40 which are common with elements of the prior art drive device 2.

As above, the drive device 40 includes first and second motorized feed rollers 4, 6 for conveying mail items 8, and having sets of moving backing-rollers facing them. The second motorized roller 6, disposed further downstream relative to the displacement direction of the mail items, also cooperates with the backing-roller 16 mounted on the fork 20 which is hinged on the common axis 22 and held to the support pin 32 by the return spring 26. However, the first motorized roller 4, disposed at the input to the drive device 40, no longer cooperates with a single backing-roller, but now cooperates with a set of backing-wheels, 42, 44, 46 of which the radiuses and position are advantageously predetermined so that when a mail item 8 is inserted it comes into contact firstly with the motorized feed roller 4.

In the preferred embodiment shown, the set of backing-wheels comprises firstly a central or middle backing-wheel 44 flexibly mounted so as to be cantilevered out on one end of a middle hinged lever 50, with the advantageously hook-shaped other end thereof being connected to a return spring 56 fixed to the common support pin 32, and secondly, on either side of the central backing-wheel, two outer backing-wheels 42, 46 each also flexibly mounted so as to be cantilevered out on one end of a respective hinged lever 48, 52, with the advantageously hook-shaped other end thereof being connected to a return spring 54, 58 also fixed to the support pin. The three hinged levers of the backing-wheels can all pivot about the common hinge axis 22.

Each of the hinged levers carrying an outer backing-wheel includes a polygonal cutout 60 designed to cooperate with two faces of an abutment 62, 64 secured to the postage meter base in order to fix upper and lower pivoting limits for pivoting the levers. The upper limit is determined by the maximum acceptable thickness for the mail items, given the physical structure of the conveyor path 36 in the postage meter. However, the lower limit, which can depend on the type of mail concerned defines a predetermined thickness from which combined action of the set of backing-wheels becomes possible. Below this lower limit, only the middle backing-wheel comes into contact with the document being conveyed. A spacer 66 secured to the hook ends of both outer hinged levers (e.g. by means of countersunk screws) guarantees simultaneous displacement of the outer backing-wheels associated with these levers. The spacer is preferably placed substantially in a plane containing the hinge axis 22 and perpendicular to the plane defining the conveyor path of the mail items, and is placed above the central hinged lever 50, so as to enable the central hinged lever to lift the outer hinged levers when a thick document is inserted in the drive device 40.

The operation of the device of the invention is as follows. At rest, the drive device 40 is in the position in FIG. 1, the central backing-wheel 44, under the effect of the return spring 56, is pressed against the motorized drive roller 4 while the outer backing-wheels 42, 46 are separated from the drive roller by a predetermined space resulting from the hinged levers 48, 52 of the outer backing-wheels being in their lower abutment position. When the document 8 is inserted on the conveyor path 36 of the postage meter base, the differences between the radiuses of the first motorized roller 4 and of the backing-wheels 42, 44, 46 cause the document to come into contact firstly with the motorized roller and then, only after being driven, with the backing-wheels. This applies whatever the thickness of the document, thus preventing unwanted stoppage of the document after it has entered the postage meter.

Depending on its thickness, the document is nipped between the motorized roller and one or more of the backing-rollers. For thin documents, only the middle backing-roller 44 comes into contact with the document being conveyed, thus enabling small pressure to be applied on the document. However, for thicker documents, all three backing-wheels 42, 44, 46 are in contact with the document, enabling a higher pressure to be exerted. Contact with the document 8 switches from one counter wheel to a plurality of backing-wheels automatically by the successive pivoting of the central hinged lever 50, and then of the outer levers 48, 52 (interconnected by the connecting spacer 60) about their common hinge axis 22, within the limit of the upper abutment position defined by the outer levers, thus enabling different pressures to be applied depending on the thickness of the document, i.e. small pressure for thin documents and high pressure for thick documents.

Naturally, the person skilled in the art is able to implement multiple variants of the invention without going beyond the ambit thereof. In particular, the backing-wheel assembly 42, 44, 46 can be inverted, with the middle backing-wheel 44 engaging only thick documents and exerting pressure on a document only after pressure has been exerted by the peripheral backing-wheels 42, 46 (which are thus intended for thin documents).

We claim:

1. A drive device for driving items of mail along a conveyor path of a postage meter base, the device being disposed upstream from a print mechanism and including first and second motorized feed rollers cooperating with associated moving backing-rollers mounted on hinged means which can pivot about a common hinge axis against return springs fixed to support means, wherein at least one of the backing-rollers comprises a middle backing-wheel mounted on a lever hinged about the common axis and disposed between twin outer backing-wheels each mounted on a respective lever also hinged about a common axis, such that mail items inserted on the conveyor path come into contact with one only of the outer backing-wheels and the middle backing-wheel, or else with all three backing-wheels, depending respectively on whether or not the items are thinner or thicker than a predetermined thickness.

2. A drive device according to claim 1, wherein the hinged levers of the outer backing-wheels are interconnected by means of a spacer.

3. A drive device according to claim 1, wherein the hinged levers of the outer backing-wheels include a polygonal cutout designed to cooperate with two faces of an abutment in order to define upper and lower pivoting limits for pivoting of the levers.

4. A drive device according to claim 1, wherein each backing-wheel is cantilevered out on one end of its respective hinged lever.

5. A drive device according to claim 1, wherein the backing-wheels present a predetermined radius less than that of the associated motorized feed roller, such that when a document is inserted in the base of the postage meter, the document is driven by the motorized roller before coming into contact with the backing-wheels.

* * * * *